US005378176A

United States Patent [19]

Sasai

[11] Patent Number: 5,378,176

[45] Date of Patent: Jan. 3, 1995

[54] CONNECTOR

[75] Inventor: Osamu Sasai, Mie, Japan

[73] Assignee: Sumitomo Wiring Systems, Ltd., Yokkaichi, Japan

[21] Appl. No.: 148,899

[22] Filed: Nov. 5, 1993

[30] Foreign Application Priority Data

Nov. 6, 1992 [JP] Japan ..... 4-322372

[51] Int. Cl.[6] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 4,583,805 | 4/1986 | Mantlik | 439/595 |
| 4,705,337 | 11/1987 | Maeda | 439/595 |
| 4,758,182 | 7/1988 | Anbo et al. | 439/592 |
| 4,867,705 | 9/1989 | Yuasa | 439/595 |
| 5,120,269 | 6/1992 | Endo et al. | 439/752 |
| 5,147,222 | 9/1992 | Hotea et al. | 439/752 |
| 5,160,283 | 11/1992 | Fry et al. | 439/752 |
| 5,292,262 | 3/1994 | Endo et al. | 439/752 |

FOREIGN PATENT DOCUMENTS

| | | |
|---|---|---|
| 2408231 | 6/1979 | France . |
| 3736036 | 2/1989 | Germany . |

*Primary Examiner*—Gary F. Paumen

*Attorney, Agent, or Firm*—Sughrue, Mion, Zinn, Macpeak & Seas

[57] ABSTRACT

A connector makes terminal-inserting work easy and allows a terminal element to be readily drawn by returning a retainer to a temporary mounting position even if it has been left for a long time. An opening 6 is formed in a housing 1 at a side wall of a terminal-accommodating hole 5. In the temporary mounting position a terminal-locking portion 22*a* is arranged in the opening 6. When a retainer 2 is pushed to a permanent mounting position, the retainer 2 is guided by engagement between an elongated guide groove 23 and a guide projection 8 and a permanent mounting lock piece 10 so that the retainer moves along an arcuate line m. Then, the terminal-locking portion 22*a* moves into the terminal-accommodating hole 5 so that the portion 22*a* pushes and locks the terminal element 3.

5 Claims, 6 Drawing Sheets

CONNECTOR

BACKGROUND OF THE INVENTION

1. Field of the Invention

This invention relates to a connector and more particularly to a connector having a double locking construction.

2. Statement of the Prior Art

For convenience of explanation, a prior connector having a double locking construction will be described below by referring now to FIGS. 9 to 12. FIG. 9 is a cross sectional view of the prior connector, illustrating a retainer 52 in a temporary mounting position. FIG. 10 is a cross sectional view of the prior connector illustrating the retainer 52 in a permanent mounting position. FIG. 11 is a cross sectional view of another prior connector, illustrating a retainer 62 in a temporary mounting position. FIG. 12 is a cross sectional view of another prior connector illustrating the retainer 62 in a permanent mounting position.

In the prior connector shown in FIG. 9, a terminal element 58 is inserted into a terminal-accommodating hole 55 in housing 51 from the rear side end of the hole. Then, a cap like retainer 52 is mounted on the rear side end of the terminal-accommodating hole 55 and the retainer 52 is moved from a temporary mounting position shown in FIG. 9 to a permanent mounting position shown in FIG. 10.

In order to allow the terminal element 58 to be inserted into the terminal-accommodating hole 55, the retainer 52 must permit the terminal element 58 to enter therein. Thus, in the prior connector, an engaging means (not shown) temporarily supports the retainer above an axis X of the terminal-accommodating hole 55. After the terminal element 58 is inserted into the hole 55, the retainer 52 is pushed down in a direction shown by an arrow A and advanced in a direction shown by an arrow B.

On the other hand, in another prior connector shown in FIG. 11, a terminal element 63 is inserted into a terminal-accommodating hole 65 in a housing 61 from the rear side end of the hole. Then, a plug like retainer 62 is pushed into the terminal-accommodating hole 65 from the rear side end and the retainer 62 is moved from a temporary mounting position shown in FIG. 11 to a permanent mounting position shown in FIG. 12.

The retainer 62 is provided with a flexible and long terminal lock piece 66 which pushes the terminal element 63. On the other hand, the terminal-accommodating hole 65 has an accommodating space 65*a* for accommodating the terminal lock piece 66 on an upper rear portion and the space 65*a* is communicated with a front side end of the terminal-accommodating hole 65 along a slant wall 65*b*. Thus, in order to move the retainer 62 to the permanent mounting position the retainer is pushed forwardly in a direction shown by an arrow B and the terminal lock piece 66 is deflected along the slant wall 65*b* so that the lock piece 66 engages with a recess 63*a*.

The former connector requires two operating steps of pushing down the retainer 52 in the direction A and advancing it in the direction B so as to displace it to the permanent mounting position. Consequently, the former connector requires a skilled worker. This impedes automatic insertion of a terminal.

The latter connector requires a great force for pushing the retainer 62 to the permanent mounting position in the case that the number of the terminal elements to be inserted is many, since the terminal lock piece 66 is deflected upon inserting the retainer 62 into the permanent position. Also, in the case of inspecting the connector in the future, it will be impossible to draw the terminal element 63 out of the connector since the terminal lock piece 66 loses its recovery force and deflects downwardly as it is, even if the retainer 62 is returned to the temporary mounting position.

SUMMARY OF THE INVENTION

An object of the present invention is to provide a connector into which a terminal element can be readily inserted and out of which the terminal element can be easily drawn upon returning to a temporary mounting position even if the connector has been left for a long time.

In order to achieve the above object, a connector of the present invention includes a housing having a terminal-accommodating hole into which a terminal element is inserted from a rear side of the housing, and a retainer having terminal-locking means which engage with the terminal element in the terminal-accommodating hole.

The retainer can be displaced between a temporary mounting position for allowing said terminal member to be inserted into the terminal-accommodating hole and a permanent mounting position forwardly from the temporary mounting position for securing the terminal element in the housing. The housing is provided with an opening in a side wall of the terminal-accommodating hole. The terminal-locking means are arranged in the temporary mounting position on a stand-by position partially outside the hole and in the opening. The housing is provided with guide means on the exterior thereof. The retainer is provided with a guide follower which guides the retainer from the opening to the hole by the guide means when the retainer is moved from the temporary mounting position to the permanent mounting position.

In addition, the guide means are formed on an arcuate line which tilts the retainer inwardly in the forward direction.

The connector described above can effect the following operation. The terminal locking means formed on the end of the retainer are arranged in the stand-by position in opposition to the opening formed on the side of the terminal-accommodating hole when the retainer is put in the temporary mounting position on the rear side of the housing. Accordingly, the terminal element can be inserted into the terminal-accommodating hole without interfering with the terminal locking means.

When the retainer is advanced from the temporary mounting position to the permanent mounting position, the retainer moves forwardly along the guide means formed on the exterior of the housing. In connection with this movement of the retainer, the terminal locking means moves from the opening to the terminal-accommodating hole. This movement of the terminal locking means is carried out by the guide follower without deflecting the terminal-locking means.

The terminal-locking means is further advanced into the terminal-accommodating hole from the side of the hole, coupled to the terminal element in the hole. Then, the retainer is held in the permanent mounting position. The terminal element is locked in the terminal-accommodating hole.

Further, when the retainer is displaced from the temporary mounting position to the permanent mounting position, the retainer is smoothly slid into the housing by pushing the guide means forwardly since the guide means are arranged on the arcuate line which tilts inwardly in the forward direction.

It will be apparent from the foregoing that the terminal-locking means are arranged on the stand-by position opposite to the opening formed in the side wall of the terminal-accommodating hole when the retainer is in the temporary mounting position and the retainer moves toward the permanent mounting position along the guide means formed on the exterior of the housing and advances into the terminal-accommodating position by pushing the retainer toward the permanent mounting position, thereby making a terminal-inserting work easy and producing a connector having a long life.

It is further possible to make terminal-inserting work easy since the guide means are arranged on the arcuate line which extends inwardly in the forward direction.

DETAILED DESCRIPTION OF THE PREFERRED EMBODIMENT

Referring now to FIGS. 1 to 8, an embodiment of a connector of the present invention will be explained below.

Figure 1:
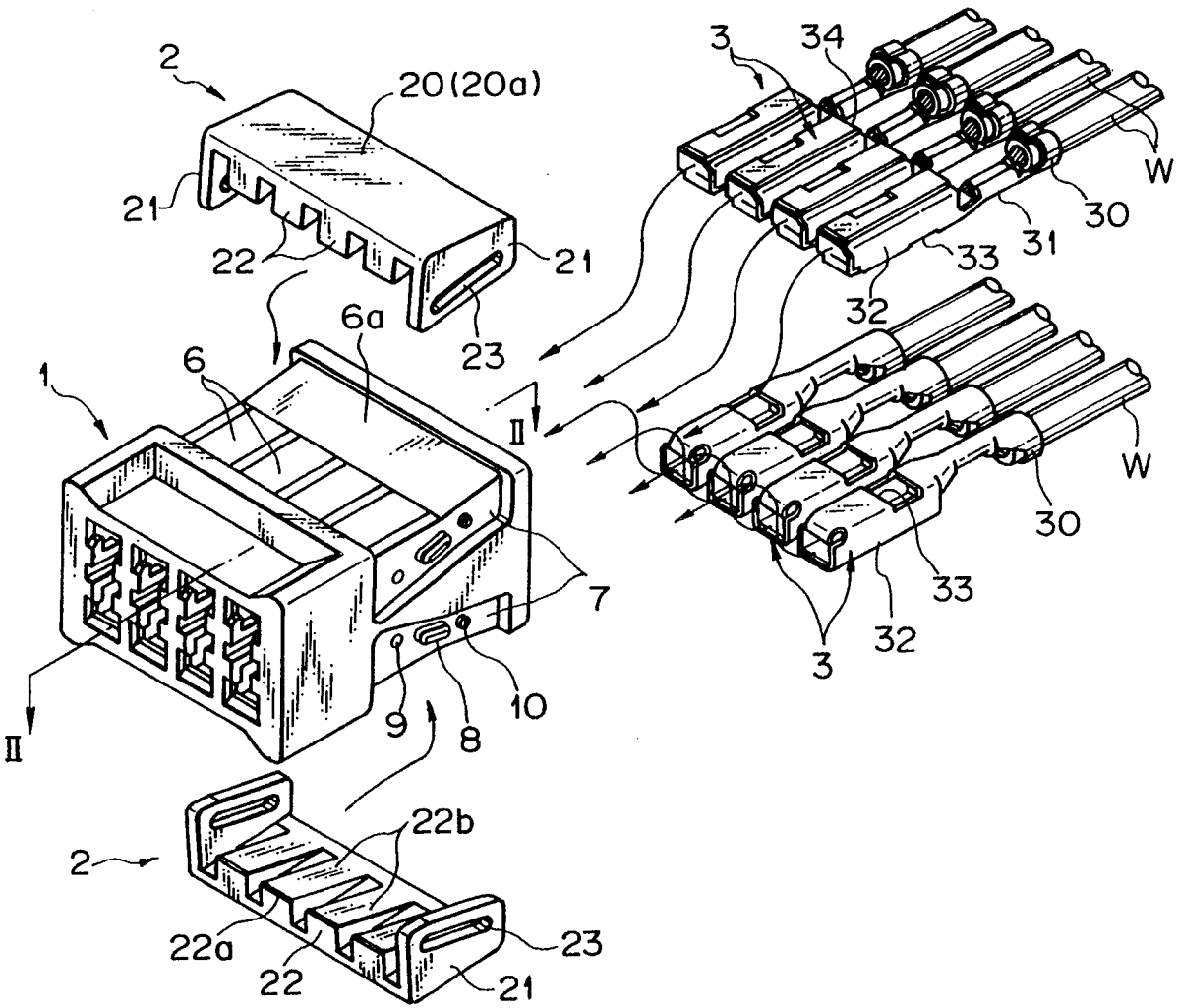
FIG. 1 is an exploded perspective view of a connector of the present invention.

As shown in FIG. 1, a connector is constituted of a generally rectangular parallelopiped housing 1, two retainers 2 each of which is mounted on upper and lower faces of the housing 1, and a terminal element 3 secured in the housing. An end of an electrical cable W is press-attached to the terminal element.

Figure 2:
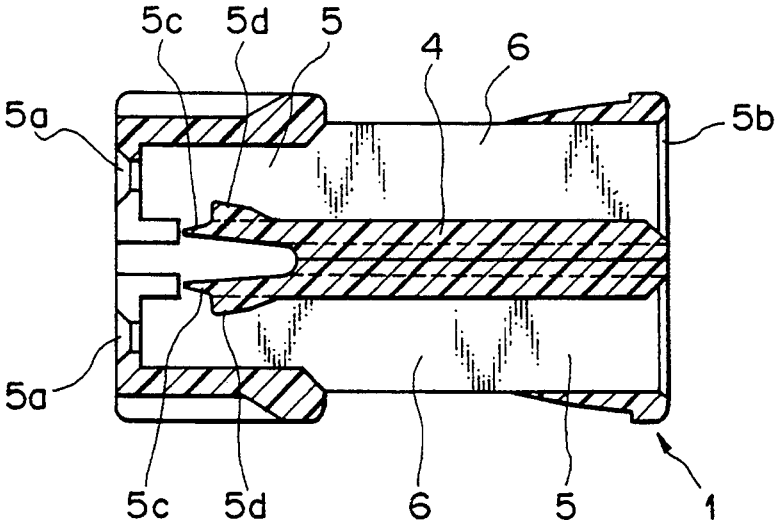
FIG. 2 is a cross sectional view of a housing taken along lines II—II in FIG. 1.

As shown in FIGS. 1 and 2, eight terminal-accommodating holes 5 are formed in the housing 1 with four holes 5 being arranged on the opposite sides of a partition wall 4. Since each of the terminal-accommodating holes 5 is of the same construction only the holes 5 on the upper side of the partition wall 4 are explained hereinafter. The terminal-accommodating hole 5 defines an elongated space for accommodating the terminal element 3 in its longitudinal direction. The hole 5 has in a forward end a small aperture **5*a* into which a male terminal element (not shown) is inserted. Also, the hole 5 has in a rear end an inlet 5*b* through which a terminal element 3 is inserted. The partition wall 4 is provided on a forward end with engaging arms 5*c* which deflect upwardly and downwardly. The engaging arm 5*c* is provided with an engaging projection 5*d* raised toward the terminal-accommodating hole. Also, openings 6 are formed in the upper wall of the housing 1 so that each opening defines a part of each hole 5. The housing 1 is provided on the rear end of each opening 6 with two slant walls 6*a* each of which tilts down to the opening 6**.

Figure 3:
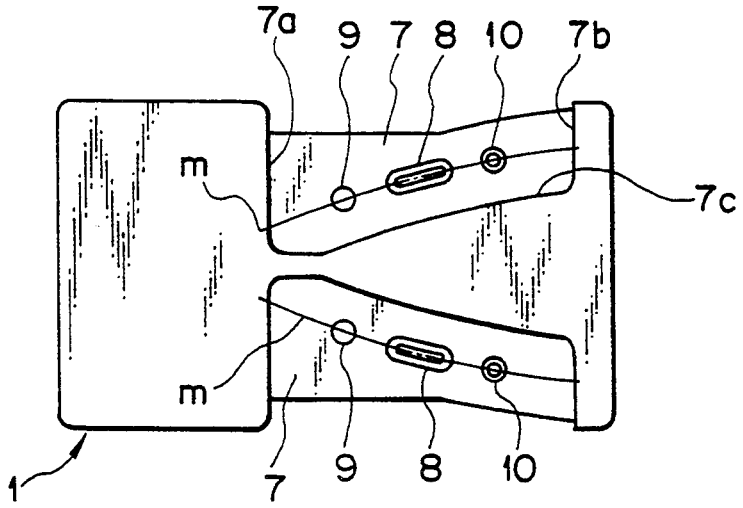
FIG. 3 is a side view of the housing in FIG. 1.

On the other hand, the housing 1 is provided with recesses 7 on the rear side on the exterior (FIG. 1. The recess 7 has a front end face **7*a*, a rear end face 7*b* and an arcuated face 7*c* inclining down between the front and rear end faces 7*a* and 7*b*, as shown in FIG. 3. The recess 7 is provided on a center area with a guide projection 8 for supporting the retainer and with a lock boss 9 for temporarily mounting the retainer 2 and a lock boss 10 for permanently mounting the retainer 2. The guide projection 8 and lock bosses 9 and 10 are arranged on an arcuate line m coaxial with the arcuated face 7*c* with the bosses 9 and 10 being disposed on the opposite sides of the guide projection 8. The guide projection 8 is higher than both lock bosses 9 and 10, so that it does not come out from an elongated guide groove 23 described hereinafter. The guide projection 8 and the temporary mounting lock boss 9 or the permanent mounting lock boss 10 serves the retainer 2** as guide means when it moves to the permanent mounting position.

As shown in FIG. 1, the retainer 2 has a retainer body 20 and a pair of legs 21 which extend downwardly on the opposite ends of the body 20 so that they form a gate along with the body 20. The exterior of the retainer body 20 defines a pushing part **20*a* for a permanent mounting operation. The retainer body 20 is provided on the interior with a plurality of raised portions 22 (four in the illustrated embodiment) which increase a thickness from the rear end to the front end, namely form a triangular cross sectional shape along the longitudinal direction. The front end of the raised portion 22 defines a terminal lock means 22*a*. The raised portion 22 has on the interior a slant face 22*b* which accords with the slant face 6*a* on the housing 1**.

Figure 4:
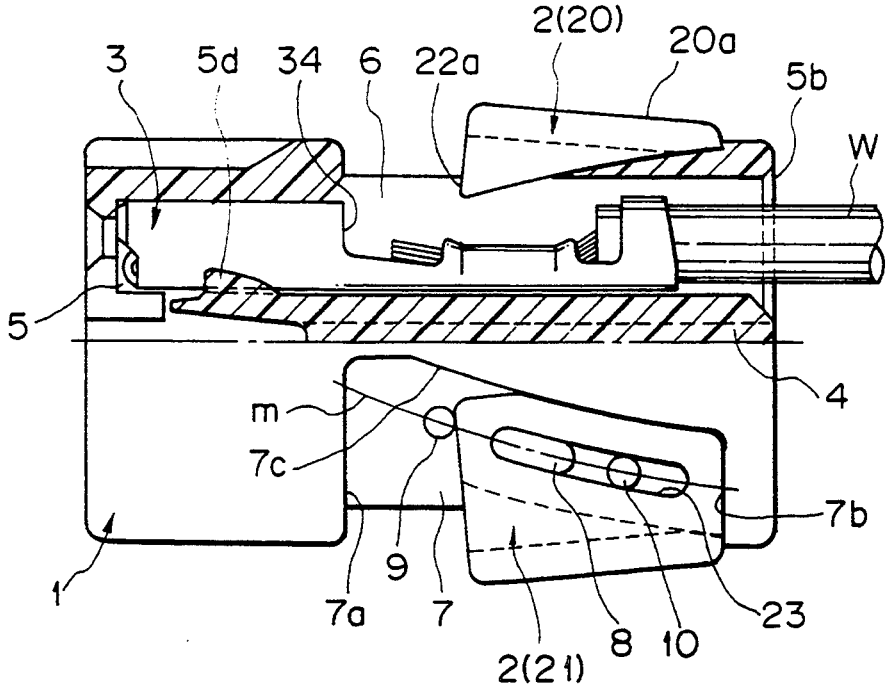
FIG. 4 is a half cross sectional view of the connector of the present invention, illustrating a retainer in a temporary mounting position.

In the temporary mounting position shown in FIG. 4, the bottom face of the leg 21 is formed into an arcuated face so that it can follow the arcuated face **7*c* of the housing 1. The leg 21 is provided with the elongated guide groove 23 described before, which receives the guide projection 8 so that the retainer 2 can move on the housing 1. The elongated guide groove 23 is formed into an arcuated curve coaxial with the arcuate line m. The groove 23** defines a guide follower which is guided by the guide projection.

Figure 5:
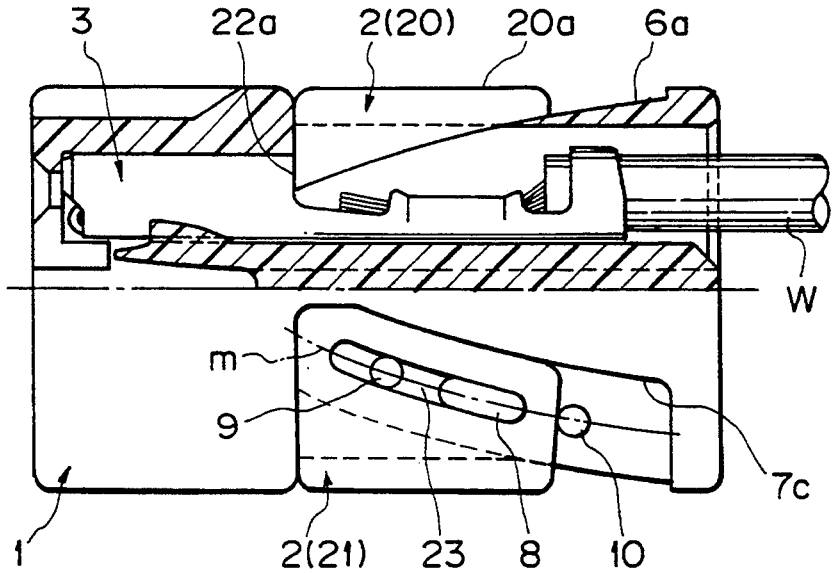
FIG. 5 is a half cross sectional view of the connector, illustrating the retainer in a permanent mounting position.

The legs 21 are deflected outwardly when the retainer 2 is displaced to the permanent mounting position, so that the legs mount on the temporary and permanent mounting lock bosses 9 and 10. The retainer 2 is guided by the guide projection 8 and permanent mounting lock boss 10 at first and the retainer 2 is guided by the guide projection 8 and temporary mounting lock boss 9 at the finished displacement. The leg 21 is clamped between the temporary mounting lock boss 9 and the guide projection 8 in the temporary mounting position (FIG. 4) while the leg 21 is clamped between the permanent mounting lock boss 10 and the guide projection 8 in the permanent mounting position (FIG. 5). Accordingly, the retainer 2 does not become loose on the housing 1 in the respective mounting positions.

In the temporary mounting position the terminal lock means 22*a* on the retainer body 20 are disposed in a stand-by position retracted from the terminal-accommodating hole 5. Thus, the terminal element 3 can be drawn from the hole 5. Further, the pushing part 20*a* slants up forwardly, so that an operator can contact with the pushing part 20*a* by the finger positively upon operating the retainer 2.

As shown in FIG. 1, an insulation barrel 30 on the rear end of the terminal element 3 closely clamps a sheath of the electrical cable while a wire barrel 31 on the front end closely clamps a conductor of the cable, thereby coupling the electrical cable to the terminal element. The terminal element 3 is provided on the front end with a cylindrical contacting portion 32 for receiving a male terminal element (not shown). The contacting portion 32 is provided on a lower wall with an engaging aperture 33 which temporarily engages with the engaging projection 5*d* formed in the housing 1 and on an upper wall with a shoulder 34 which contacts with the terminal lock means 22*a*.

Next, an operation of the embodiment of the connector will be described below.

First, as shown in FIG. 1, two retainers 2 are put and pushed on the upper and lower faces of the housing 1. Then, the guide projection 8 and permanent mounting lock boss 10 mate with the elongated guide groove 23 so that the retainer 2 is supported on the temporary mounting position shown in FIG. 4. The terminal locking means 22*a* are disposed on the stand-by position in the opening 6 in the side wall of the terminal-accommodating hole 5, where the terminal lock means 22*a* do not impede insertion of the terminal element 3.

Secondly, the respective terminal elements 3 are inserted through the respective inlets 5*b* into the respective terminal-accommodating holes 5. When the terminal element 3 is inserted into the deepest portion in the hole 5, the engaging arm 5*c* is deflected and then the aperture 33 in the lower wall of the terminal element 3 receives the engaging projection 5*d*. Thus, the terminal element 3 is held on the temporary mounting position shown in FIG. 4.

Thirdly, in order to set the permanent mounting position, the pushing part 20*a* is pushed forwardly by an operator's finger. Then, the retainer 2 moves on the arcuated face 7*c* along the arcuate line m while being guided by the guide projection 8 and permanent mounting lock boss 10. The leg 21 rides across the temporary mounting boss 9 at the front end while being deflected outwardly by a pushing force and then the boss 9 enters into the elongated guide groove 23. When the front end of the leg 21 reaches the front end face 7*a*, the rear end of the elongated guide groove 23 abuts on the guide projection 8 to stop the retainer 2 at the permanent mounting position shown in FIG. 5. The leg 21 moves to the permanent mounting position while riding across the permanent mounting lock boss 10. After the rear end of the leg 21 has ridden across the permanent mounting lock boss 10, the rear end of the elongated guide groove 23 abut on the guide projection 8 to stop the retainer 2 at the permanent mounting position.

In connection with advancement of the retainer 2, the terminal-locking means 22*a* moves from the opening 6 to the terminal-accommodating hole so that the means 22*a* abuts on the aperture 33 in the terminal element 3 and so that the terminal element 3 is locked in the terminal-accommodating hole 5. In the permanent mounting position, since the housing 1 and retainer 2 are not subject to any stress for deflecting them at any portions, the retainer 2 is held at the permanent mounting position without causing any age deformation at any portions. Accordingly, even if the retainer 2 must be returned to the temporary mounting position upon maintenance, it is possible to easily return the retainer 2 to the temporary mounting position and to readily exchange the terminal element 3.

Also, since the retainer 2 advances along the arcuate line m downwardly in the forward direction, the pushing part 20*a* gradually tilts down from the upward slant temporary mounting position to the permanent mounting position where the pushing part 20*a* accords with the exterior of the housing 1. Consequently, it is possible from the slant posture of the pushing part 20*a* to easily confirm whether or not the connector is kept in the permanent mounting position.

Figure 6:
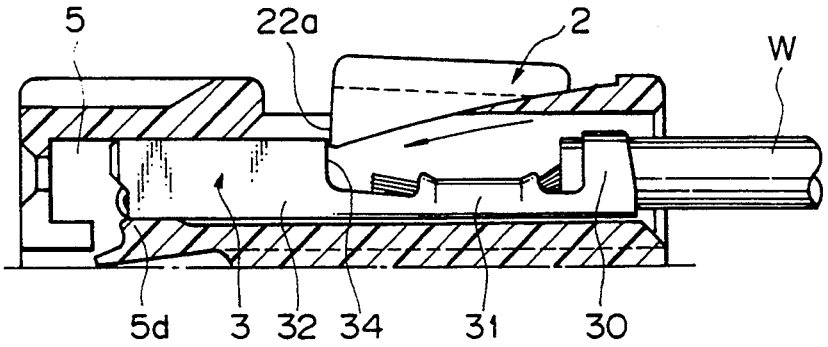
FIG. 6 is a half cross sectional view of the connector, illustrating the retainer which is being moved from another temporary mounting position to the permanent mounting position.
Figure 7:
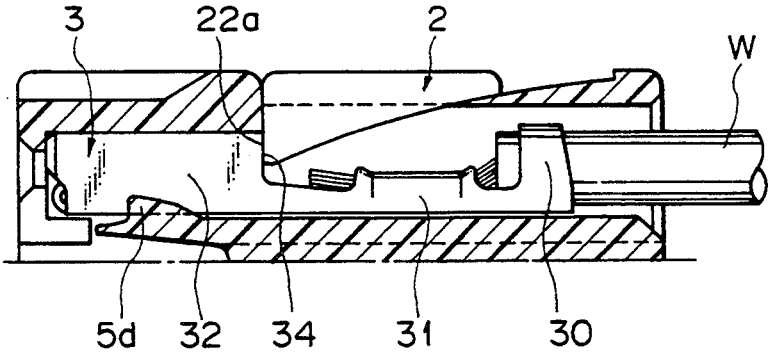
FIG. 7 is a half cross sectional view of the connector, illustrating the retainer in a permanent mounting position advanced from the position shown in FIG. 6.

Since it is possible to move the terminal element 3 to the permanent mounting position by moving forward the shoulder 34 on the terminal element 3 by the terminal-locking means 22*a* even if the terminal element 3 is incompletely inserted into the terminal-accommodating hole 5 as shown in FIG. 6, the terminal element 3 can be held in the permanent mounting position shown in FIG. 7 only by advancing the retainer 2.

Figure 8:
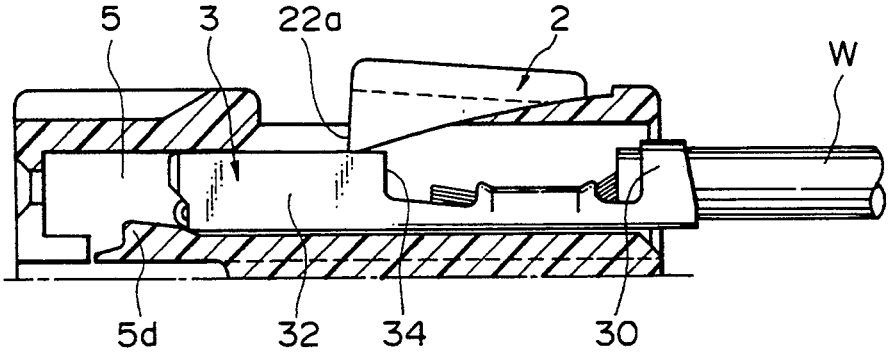
FIG. 8 is a half cross sectional view of the connector, illustrating a way of detecting a terminal in an incomplete coupling position.
Figure 9:
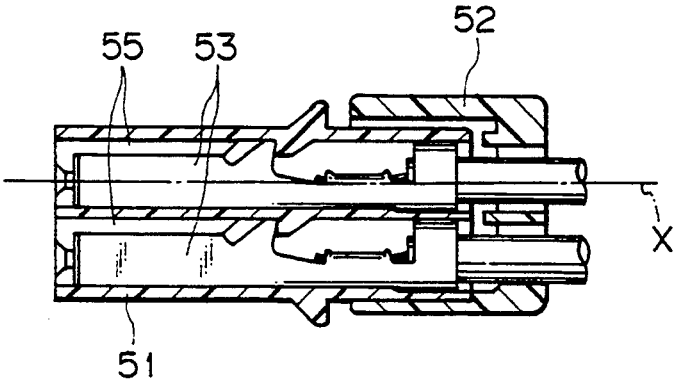
Fig. 9 PRIOR ART
FIG. 9 is a cross sectional view of a prior connector, illustrating a retainer in a temporary mounting position.
Figure 10:
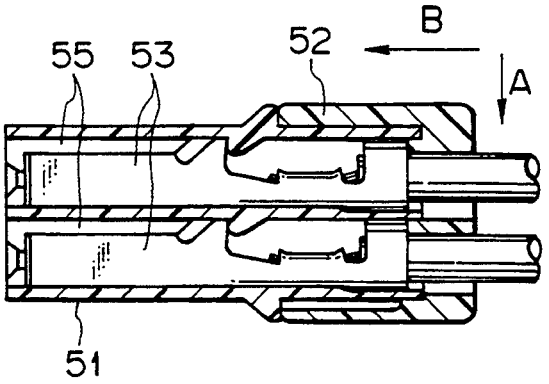
Fig. 10 PRIOR ART
FIG. 10 is a cross sectional view of the prior connector, illustrating the retainer in a permanent mounting position.
Figure 11:
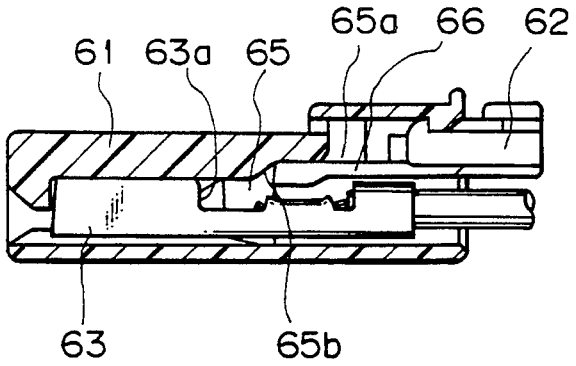
Fig. 11 PRIOR ART
FIG. 11 is a cross sectional view of another prior connector, illustrating a retainer in a temporary mounting position.
Figure 12:
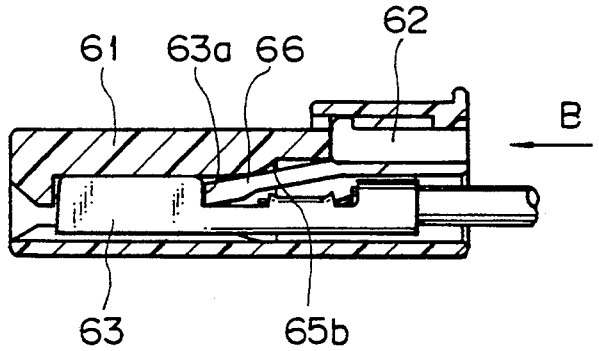
Fig. 12 PRIOR ART
FIG. 12 is a cross sectional view of another prior connector, illustrating the retainer in a permanent mounting position.

Also, as shown in FIG. 8, in the case that the terminal element 3 is incompletely inserted into the terminal-accommodating hole 5, the pushing part 20*a* cannot advance since the terminal-locking means 22*a* abuts on the side face of the contacting portion 32. Accordingly, it is possible to easily detect an incomplete insertion of the terminal element.

Although the retainer 2 moves along the arcuate line in the above embodiment, the arcuate line m may be changed to a straight slant line.

Although the guide means are constituted of the guide projection 8 and temporary and permanent mounting lock bosses 9 and 10 and the guide follower is the elongated guide groove 23 in the above embodiment, another guide mechanism may be provided which can guide the retainer 2 inwardly in the forward direction when it moves from the temporary mounting position to the permanent mounting position.

What is claimed is:

1. A connector including a housing having a terminal-accommodating hole into which a terminal element is inserted from a rear side of the housing, and a retainer having terminal-locking means which engage with said terminal element in said terminal accommodating hole, wherein said retainer can be displaced between a temporary mounting position for allowing said terminal member to be inserted into said terminal-accommodating hole and a permanent mounting position forwardly from said temporary mounting position for securing said terminal element in said housing;

said connector being characterized in that:

said housing is provided with an opening in a side wall of said terminal-accommodating hole;

said terminal-locking means are arranged in said temporary mounting position on a stand-by position outside said hole and in said opening;

said housing is provided with guide means on the exterior thereof which are formed on an arcuate line which tilts said retainer inwardly in the forward direction; and said retainer is provided with a guide follower which guides said retainer from said opening to said hole by moving across said guide means when said retainer is moved from said temporary mounting position to said permanent mounting position.

2. A connector according to claim 1, wherein said guide follower moves across said guide means from said temporary mounting position to said permanent mounting position in a single action.

3. A connector according to claim 1, wherein said terminal-locking means engages said terminal element in said permanent mounting position without any substantial deflection of said terminal locking means.

4. A connector according to claim 1, wherein said guide means comprises a plurality of projections.

5. A connector according to claim 4, wherein said guide follower comprises a guide groove for moving across said plurality of projections.

* * * * *